US012339026B2

(12) United States Patent
Tokudi

(10) Patent No.: US 12,339,026 B2
(45) Date of Patent: Jun. 24, 2025

(54) AIR-CONDITIONER

(71) Applicant: Hitachi-Johnson Controls Air Conditioning, Inc., Tokyo (JP)

(72) Inventor: Mikihito Tokudi, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 239 days.

(21) Appl. No.: 18/313,405

(22) Filed: May 8, 2023

(65) Prior Publication Data

US 2024/0377093 A1 Nov. 14, 2024

Related U.S. Application Data

(63) Continuation of application No. PCT/JP2022/035118, filed on Sep. 21, 2022.

(51) Int. Cl.
*F24F 11/84* (2018.01)
*F25B 30/02* (2006.01)

(52) U.S. Cl.
CPC ..... *F24F 11/84* (2018.01); *F25B 30/02* (2013.01); *F25B 2400/0409* (2013.01); *F25B 2600/2513* (2013.01); *F25B 2700/2101* (2013.01)

(58) Field of Classification Search
CPC ..... F25B 1/00; F25B 30/02; F25B 2400/04; F25B 2400/0409; F25B 2600/2513; F25B 2700/2101; F25B 2700/2102; F25B 2700/21142; F24F 11/34
See application file for complete search history.

(56) References Cited

U.S. PATENT DOCUMENTS

| | | | | |
|---|---|---|---|---|
| 6,474,087 | B1 * | 11/2002 | Lifson | F04C 29/0014 62/199 |
| 2005/0235689 | A1 * | 10/2005 | Lifson | F25B 49/02 62/513 |
| 2011/0083456 | A1 * | 4/2011 | Wakamoto | F25B 41/00 62/115 |
| 2017/0167762 | A1 * | 6/2017 | Kato | F25B 41/38 |
| 2019/0017730 | A1 * | 1/2019 | Matsukura | F25B 1/053 |
| 2022/0057122 | A1 * | 2/2022 | Kasai | F25B 41/26 |

FOREIGN PATENT DOCUMENTS

| | | | |
|---|---|---|---|
| JP | 2000-274859 | A | 10/2000 |
| JP | 4767340 | B2 | 9/2011 |

* cited by examiner

*Primary Examiner* — Marc E Norman
(74) *Attorney, Agent, or Firm* — Mattingly & Malur, PC

(57) ABSTRACT

An air-conditioner including a main refrigerant circuit having a compressor, a heat-source-side heat exchanger, an expansion valve, and a utilization-side heat exchanger, a bypass path, another expansion valve that decompresses refrigerant flowing in the bypass path, an internal heat exchanger, an opening degree adjuster, and a setter that sets the target temperature difference on the basis of the degree of subcooling of the utilization-side heat exchanger.

5 Claims, 3 Drawing Sheets

AIR-CONDITIONER

CROSS-REFERENCE TO RELATED APPLICATION

The present application is a continuation application of International Application No. PCT/JP2022/35118, filed on Sep. 21, 2022, the entire content of which is hereby incorporated by reference.

BACKGROUND OF THE INVENTION

1. Technical Field

The present invention relates to an air-conditioner.

2. Related Art

In a refrigeration cycle, as an outdoor air temperature decreases, a compressor suction density decreases, so that a heating capacity decreases even in the case of the same rotation speed of a compressor. On the other hand, JP-A-2000-274859 discloses an air-conditioner of which the heating capacity is improved by injection of part of high-pressure liquid refrigerant. Moreover, Japanese Patent No. 4767340 discloses a technique of controlling, in order to adjust the flow rate of refrigerant flowing in an injection circuit, the degree of opening of an expansion valve of the injection circuit such that the discharge temperature of a compressor coincides with a target value, thereby improving a heating capacity when outdoor air is at a low temperature. Further, Japanese Patent No. 4767340 discloses that a target value of the discharge temperature of the compressor can be set to a value at which the heating capacity is maximized or a value at which an operation efficiency is maximized.

SUMMARY

An air-conditioner according to the present embodiment includes a main refrigerant circuit having a compressor, a heat-source-side heat exchanger, a first expansion valve, and a utilization-side heat exchanger, a bypass path that allows part of refrigerant flowing from the utilization-side heat exchanger to the heat-source-side heat exchanger to join refrigerant compressed to an intermediate pressure by the compressor, a second expansion valve that decompresses refrigerant flowing in the bypass path, an internal heat exchanger that provides heat of refrigerant flowing from the utilization-side heat exchanger to the heat-source-side heat exchanger in the main refrigerant circuit to refrigerant decompressed in the bypass path, an opening degree adjuster that adjusts, in heating operation, the degree of opening of the second expansion valve on the basis of a refrigerant temperature difference between the outlet and inlet of the internal heat exchanger in the bypass path and a target temperature difference, and a setter that sets the target temperature difference on the basis of the degree of sub-cooling of the utilization-side heat exchanger.

DETAILED DESCRIPTION

Figure 1:
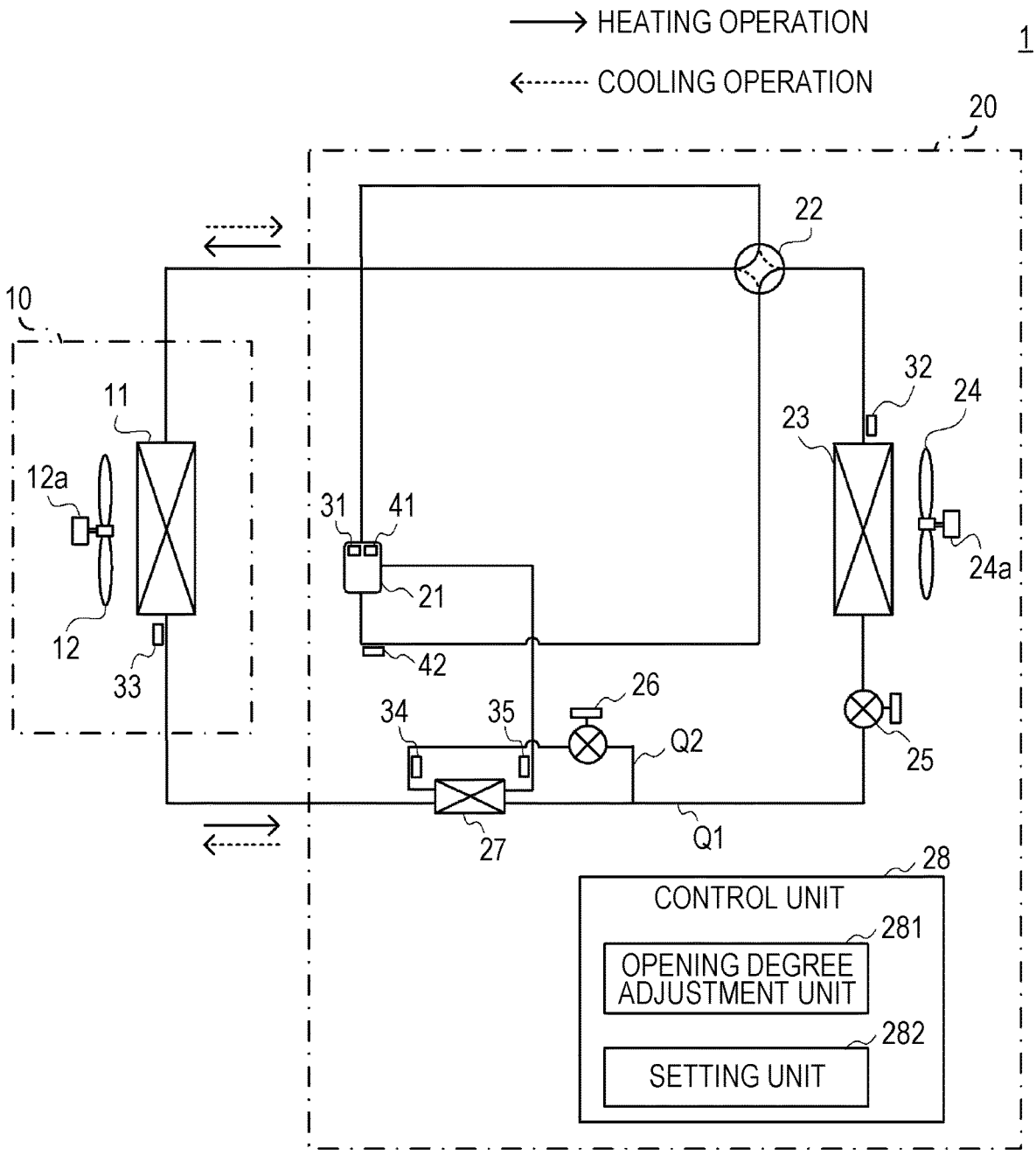
FIG. 1 is a configuration diagram of an air-conditioner.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, compressor characteristics (operation efficiency) vary depending on the type of compressor or the operation status, such as a rotation speed or a compression ratio, of the compressor, and a discharge temperature may vary even in the case of the same suction and discharge pressures and the same suction temperature. For this reason, the target value of the discharge temperature of the compressor at the time of injection needs to vary depending on the type or operation status of the compressor. When setting the target value, there is a problem that the amount of data required to determine the value at which the heating capacity is maximized or the value at which the operation efficiency is maximized is great and it takes time to set the target value.

The present invention has been made in view of such a problem, and an object thereof is to control an injection amount without the need for acquiring a great amount of data.

Thus, the present invention relates to an air-conditioner including a main refrigerant circuit having a compressor, a heat-source-side heat exchanger, a first expansion valve, and a utilization-side heat exchanger, a bypass path that allows part of refrigerant flowing from the utilization-side heat exchanger to the heat-source-side heat exchanger to join refrigerant compressed to an intermediate pressure by the compressor, a second expansion valve that decompresses refrigerant flowing in the bypass path, an internal heat exchanger that provides heat of refrigerant flowing from the utilization-side heat exchanger to the heat-source-side heat exchanger in the main refrigerant circuit to refrigerant decompressed in the bypass path, an opening degree adjuster that adjusts, in heating operation, the degree of opening of the second expansion valve on the basis of a refrigerant temperature difference between the outlet and inlet of the internal heat exchanger in the bypass path and a target temperature difference, and a setter that sets the target temperature difference on the basis of the degree of sub-cooling of the utilization-side heat exchanger.

According to the present invention, the injection amount can be controlled without the need for acquiring a great amount of data.

FIG. 1 is a diagram showing an air-conditioner according to an embodiment. The air-conditioner 1 performs air-conditioning by circulating refrigerant in a refrigeration cycle. The air-conditioner 1 includes an indoor unit 10 installed inside a room (air-conditioning target space) and an outdoor unit 20 installed outside the room (outdoor space). The indoor unit 10 and the outdoor unit 20 are connected to each other through a main refrigerant circuit Q1 formed of a refrigerant pipe. Note that a solid arrow shown in FIG. 1 indicates the flow of refrigerant during heating operation. Moreover, a dashed arrow shown in FIG. 1 indicates the flow of refrigerant during cooling operation.

The indoor unit 10 includes a utilization-side heat exchanger 11 and a utilization-side fan 12. The utilization-side heat exchanger 11 exchanges heat between refrigerant flowing in a heat transfer pipe (not shown) thereof and indoor air sent from the utilization-side fan 12. The utilization-side heat exchanger 11 operates as a condenser or an evaporator by switching of a four-way valve 22. The utilization-side fan 12 is installed in the vicinity of the utilization-side heat exchanger 11. The utilization-side fan 12 sends indoor air to the utilization-side heat exchanger 11 by drive of a utilization-side fan motor 12*a*.

The outdoor unit 20 includes a compressor 21, the four-way valve 22, a heat-source-side heat exchanger 23, a heat-source-side fan 24, a first expansion valve 25, a second expansion valve 26, an internal heat exchanger 27, and a control unit 28. The compressor 21 compresses low-temperature low-pressure gas refrigerant, and discharges high-temperature high-pressure gas refrigerant. The heat-source-side heat exchanger 23 exchanges heat between refrigerant flowing in a heat transfer pipe thereof and outdoor air sent from the heat-source-side fan 24. The heat-source-side heat exchanger 23 operates as a condenser or an evaporator by switching of the four-way valve 22.

The heat-source-side fan 24 is installed in the vicinity of the heat-source-side heat exchanger 23. The heat-source-side fan 24 sends outdoor air to the heat-source-side heat exchanger 23 by drive of a heat-source-side fan motor 24*a*. The first expansion valve 25 has a function of decompressing refrigerant condensed in the "condenser" (one of the heat-source-side heat exchanger 23 or the utilization-side heat exchanger 11). Note that refrigerant decompressed in the first expansion valve 25 is guided to the "evaporator" (the other one of the heat-source-side heat exchanger 23 or the utilization-side heat exchanger 11).

The four-way valve 22 is a valve that switches a refrigerant flow path according to an operation mode of the air-conditioner 1. In the cooling operation, the four-way valve 22 is switched such that in the refrigeration cycle, refrigerant circulates in the compressor 21, the heat-source-side heat exchanger 23 (condenser), the first expansion valve 25, and the utilization-side heat exchanger 11 (evaporator) in this order as indicated by the dashed arrows. In the heating operation, the four-way valve 22 is switched such that in the refrigeration cycle, refrigerant circulates in the compressor 21, the utilization-side heat exchanger 11 (condenser), the first expansion valve 25, and the heat-source-side heat exchanger 23 (evaporator) in this order as indicated by the solid arrows. That is, in main refrigerant circuit Q1 in which refrigerant circulates in the refrigeration cycle through the compressor 21, the "condenser," the first expansion valve 25, and the "evaporator" in this order, one of the "condenser" or the "evaporator" is the heat-source-side heat exchanger 23, and the other one of the "condenser" or the evaporator" is the utilization-side heat exchanger 11.

As described above, in the air-conditioner 1, the utilization-side heat exchanger 11, the compressor 21, the four-way valve 22, the heat-source-side heat exchanger 23, and the first expansion valve 25 form the main refrigerant circuit Q1. Further, in the air-conditioner 1, a bypass circuit Q2 is provided in the main refrigerant circuit Q1. the bypass circuit Q2 being branched from between the utilization-side heat exchanger 11 and the heat-source-side heat exchanger 23 and joined to an intermediate portion of the compressor 21. The bypass circuit Q2 allows part of refrigerant flowing in the main refrigerant circuit Q1 and flowing from the utilization-side heat exchanger 11 to the heat-source-side heat exchanger 23 to join refrigerant compressed to an intermediate pressure in the compressor 21. The bypass circuit Q2 is provided with the second expansion valve 26 and the internal heat exchanger 27. The second expansion valve 26 slightly decompresses inflow refrigerant from the main refrigerant circuit Q1. The internal heat exchanger 27 exchanges heat between refrigerant in the main refrigerant circuit Q1 and refrigerant in the bypass circuit Q2. That is, the internal heat exchanger 27 applies heat of refrigerant flowing from the utilization-side heat exchanger 11 to the heat-source-side heat exchanger 23 in the main refrigerant circuit Q1 to refrigerant decompressed by the second expansion valve 26 of the bypass circuit Q2.

A first temperature sensor 31 is provided on a discharge side of the compressor 21. A second temperature sensor 32 is provided at the inlet/outlet of the heat-source-side heat exchanger 23 on a four-way valve 22 side. A third temperature sensor 33 is provided at the inlet/outlet of the utilization-side heat exchanger 11 on an internal heat exchanger 27 side. In the bypass circuit Q2, a fourth temperature sensor 34 and a fifth temperature sensor 35 are each provided on the suction side and discharge side of the internal heat exchanger 27. A first pressure sensor 41 is provided on the discharge side of the compressor 21, and a second pressure sensor 42 is provided between the compressor 21 and the four-way valve 22.

Figure 2:
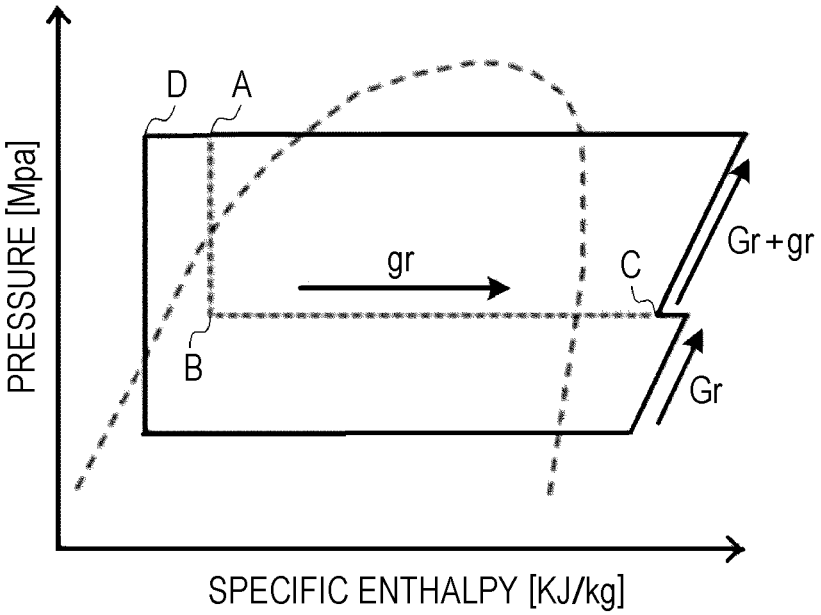
FIG. 2 is a PH diagram.

FIG. 2 is a PH diagram in the heating operation. In the bypass circuit Q2 in heating, part of refrigerant condensed in the utilization-side heat exchanger 11 is decompressed in the second expansion valve 26 (A-B). By heat exchange between refrigerant in the main refrigerant circuit Q1 and refrigerant in the bypass circuit Q2 in the internal heat exchanger 27, the refrigerant in the main refrigerant circuit Q1 is subcooled (A-D), and the refrigerant in the bypass circuit Q2 is gasified (B-C) and injected into the compressor 21. In this manner, a gas injection cycle is formed by the bypass circuit Q2.

By injection, the amount of refrigerant discharged from the compressor 21 reaches the sum (Gr+gr) of a sucked refrigerant amount Gr and an injected refrigerant amount gr, and is greater than the sucked refrigerant amount. Accordingly, the amount of refrigerant flowing to the utilization-side heat exchanger 11 operating as the condenser increases, and a heating capacity increases. On the other hand, since gas refrigerant is injected at the intermediate pressure into the compressor 21, a compression work from a low pressure to the intermediate pressure decreases. As a result, the heating capacity of the compressor 21 when outdoor air is at a low temperature is improved, and an operation efficiency is improved.

On the other hand, the operation efficiency of the air-conditioner 1 is also influenced by a pressure state. When the degree of subcooling at the outlet of the utilization-side heat exchanger 11 of the indoor unit 10 increases, an enthalpy difference increases and a condensing capacity increases. However, as the degree of subcooling increases, a refrigerant-side heat transfer coefficient in the condenser decreases. For this reason, the overall performance of the utilization-side heat exchanger 11 decreases, and the level of high pressure increases. Since the compression work increases accordingly, there is the degree of subcooling at which the operation efficiency is maximized. Thus, in the air-conditioner 1, the degree of subcooling of the utilization-side heat exchanger 11 is preferably appropriately adjusted.

The control unit 28 of the outdoor unit 20 includes, as a configuration for performing such control, an opening degree adjustment unit 281 and a setting unit 282. The opening degree adjustment unit 281 adjusts the degrees of opening of the first expansion valve 25 and the second expansion valve 26. The setting unit 282 sets, in the bypass circuit Q2, a target temperature difference which is a target value of a difference in a refrigerant temperature between the outlet and inlet of the internal heat exchanger 27. The control unit 28 includes a processor, a main storage device, and an auxiliary storage device, and the opening degree adjustment unit 281 and the setting unit 282 are implemented in such a manner that the processor executes a program stored in the auxiliary storage device. Note that as another example, the opening degree adjustment unit 281 and the setting unit 282 may be implemented by hardware.

Figure 3:
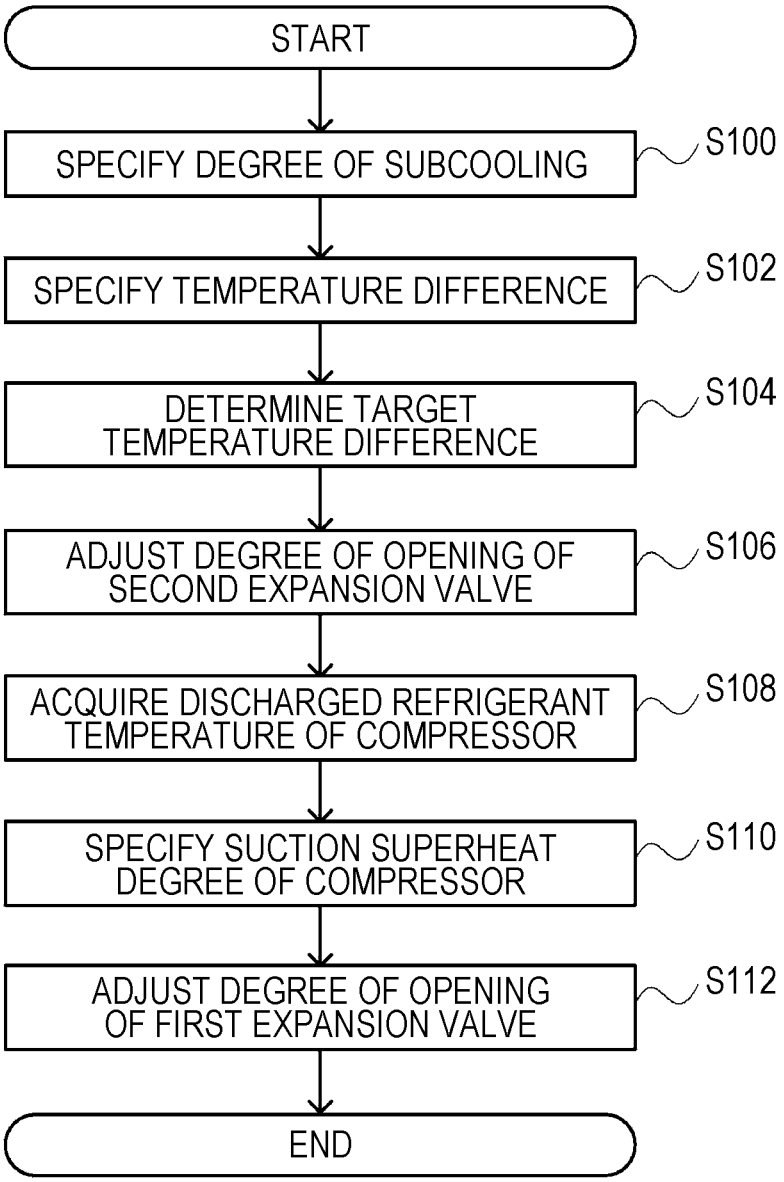
FIG. 3 is a flowchart showing control.

FIG. 3 is a flowchart showing the control by the control unit 28 in the heating operation. This control is executed at regular intervals. In the present control, first in S100, the control unit 28 specifies the degree of subcooling. Specifically, the control unit 28 specifies, as the degree of subcooling, a difference between a refrigerant temperature calculated from a saturation temperature at a discharge pressure sensed by the first pressure sensor 41 and a refrigerant temperature sensed on the outlet side of the operating utilization-side heat exchanger 11 by the third temperature sensor 33. Note that a method for specifying the degree of subcooling is not limited to that of the embodiment. As another example, a temperature sensor may be arranged at an intermediate position of the utilization-side heat exchanger 11, and the control unit 28 may specify, as the degree of subcooling, a difference between a temperature sensed in a gas-liquid two-phase state by the temperature sensor and the refrigerant temperature sensed on the outlet side of the utilization-side heat exchanger 11 by the third temperature sensor 33.

Next, in S102, the control unit 28 specifies a temperature difference between the inlet and outlet of the internal heat exchanger 27. Specifically, the control unit 28 acquires an outlet-side refrigerant temperature sensed on the outlet side of the internal heat exchanger 27 by the fifth temperature sensor 35 and an inlet-side refrigerant temperature sensed on the inlet side of the internal heat exchanger 27 by the fourth temperature sensor 34. Then, the control unit 28 specifies, as the temperature difference, a difference between the outlet-side refrigerant temperature and the inlet-side refrigerant temperature.

Next, in S104, the setting unit 282 determines the target temperature difference. Here, the target temperature difference is the target value of the temperature difference between the inlet and outlet of the internal heat exchanger 27. The target temperature difference is a value determined according to the degree of subcooling, and is a value that decreases as the degree of subcooling increases. For example, the target temperature difference when the degree of subcooling is a first value is greater than the target temperature difference when the degree of subcooling is a second value greater than the first value. The setting unit 282 determines the target temperature difference from the degree of subcooling. Note that the setting unit 282 determines the target temperature difference from the degree of subcooling by using a preset function indicating a correspondence relationship between the degree of subcooling and the target temperature difference. As another example, a correspondence table indicating the correspondence between the target temperature difference and the degree of subcooling may be set in advance for the control unit 28, and the setting unit 282 may determine the target temperature difference from the degree of subcooling according to the correspondence table.

As described above, there is the degree of subcooling at which the operation efficiency is maximized. The degree of subcooling at which the operation efficiency is maximized is set as a target degree of subcooling, and the target temperature difference is set such that the degree of subcooling reaches the target degree of subcooling. That is, the target temperature difference is set on the basis of the degree of subcooling and the target degree of subcooling.

Next, in S106, the opening degree adjustment unit 281 of the control unit 28 adjusts the degree of opening of the second expansion valve such that an actual temperature difference reaches the target temperature difference. For example, in a case where the degree of subcooling is greater than the target degree of subcooling, a value smaller than the actual temperature difference is set as the target temperature difference. In this case, the opening degree adjustment unit 281 increases the degree of opening of the second expansion valve 26 to decrease the temperature difference and bring the temperature difference close to the target temperature difference. Accordingly, the amount of refrigerant flowing in the bypass circuit Q2 increases, the amount of heat exchange in the internal heat exchanger 27 also increases, and the degree of subcooling on the inlet side of the heat-source-side heat exchanger 23 of the main refrigerant circuit Q1 increases. Since liquid refrigerant has a high density, the amount of refrigerant held in the heat-source-side heat exchanger 23 increases, and the amount of refrigerant held in the utilization-side heat exchanger 11 relatively decreases. As a result, the degree of subcooling on the outlet side of the utilization-side heat exchanger 11 decreases. As described above, in a case where the degree of subcooling is great, the degree of subcooling can be further decreased in such a manner that the degree of opening of the second expansion valve is increased such that the temperature difference reaches the target temperature difference.

On the other hand, in a case where the degree of subcooling is smaller than the target degree of subcooling, a value greater than the actual temperature difference is set as the target temperature difference. In this case, the opening degree adjustment unit 281 decreases the degree of opening of the second expansion valve 26 to increase the temperature difference and bring the temperature difference close to the target temperature difference. Accordingly, the amount of refrigerant flowing in the bypass circuit Q2 decreases, and the degree of subcooling on the outlet side of the utilization-side heat exchanger 11 increases. As described above, in a case where the degree of subcooling is small, the degree of subcooling can be further increased in such a manner that the degree of opening of the second expansion valve 26 is decreased such that the temperature difference reaches the target temperature difference. The target temperature difference is set according to the degree of subcooling, and the degree of opening of the second expansion valve 26 is adjusted accordingly. In this manner, an injection amount can be adjusted, and the operation efficiency can be improved.

Note that in S106, the control unit 28 repeats a process of increasing or decreasing the degree of opening of the second expansion valve 26 by a certain amount and confirming again the temperature difference between the inlet and outlet of the internal heat exchanger 27 after a lapse of a certain period of time, thereby bringing the temperature difference close to the target temperature difference.

Next, in S108, the control unit 28 acquires the discharged refrigerant temperature of the compressor 21 sensed by the first temperature sensor 31. Next, in S110, the control unit 28 specifies the suction superheat degree of the compressor 21. Specifically, the control unit 28 specifies, as a suction superheat degree, a difference between a refrigerant temperature calculated from an evaporation temperature at a pressure sensed by the second pressure sensor 42 and a refrigerant temperature sensed on the outlet side of the heat-source-side heat exchanger 23 by the second temperature sensor 32. Note that a method for specifying the degree of superheat is not limited to that of the embodiment. As another example, a temperature sensor may be arranged at an intermediate position of the heat-source-side heat exchanger 23, and the control unit 28 may specify, as the degree of superheat, a difference between a temperature sensed in a gas-liquid two-phase state by the temperature sensor and the refrigerant temperature sensed on the outlet side of the heat-source-side heat exchanger 23 by the second temperature sensor 32.

Next, in S112, the opening degree adjustment unit 281 adjusts the degree of opening of the first expansion valve 25 on the basis of the discharged refrigerant temperature and suction superheat degree of the compressor 21. Specifically, the opening degree adjustment unit 281 increases the degree of opening of the first expansion valve 25 in a case where the discharged refrigerant temperature exceeds a preset target temperature. On the other hand, the opening degree adjustment unit 281 decreases the degree of opening of the first expansion valve 25 in a case where the suction superheat degree is less than a target value of the degree of superheat. The opening degree adjustment unit 281 increases the degree of opening of the first expansion valve 25 in a case where the suction superheat degree exceeds the target value of the degree of superheat. Here, it is assumed that the target value of the degree of superheat is determined in advance. Note that the degree of opening needs to be increased according to the discharged refrigerant temperature and needs to be decreased according to the suction superheat degree. In this case, the opening degree adjustment unit 281 obtains an average degree of opening of an amount by which the degree of opening is increased and an amount by which the degree of opening is decreased, and adjusts the degree of opening to the obtained degree of opening.

The degree of opening of the first expansion valve 25 is generally controlled, in the heating operation, according to the degree of superheat on the outlet side of the heat-source-side heat exchanger 23 or the suction superheat degree of the compressor 21. When outdoor air is at a low temperature, the compressor is operated with a high compression ratio, and the discharge temperature of the compressor 21 tends to be high. As described above, the discharge temperature can be decreased by injection in the bypass circuit Q2. However, since a valve with a relatively-small capacity is used as the second expansion valve 26 and refrigerant is injected into the compressor 21 at the intermediate pressure, the injection amount is limited. For this reason, in the air-conditioner 1 of the present embodiment, the degree of opening of the first expansion valve 25 of the main refrigerant circuit Q1 is adjusted in addition to adjustment of the injection amount, as described above. As a result, a rapid increase in the discharge temperature of the compressor 21 can be suppressed.

As described above, the air-conditioner 1 of the present embodiment determines the target temperature difference between the inlet and outlet of the internal heat exchanger 27 according to the degree of subcooling of the utilization-side heat exchanger 11, and adjusts the degree of opening of the second expansion valve 26 such that the temperature difference between the inlet and the outlet reaches the target temperature difference. The air-conditioner 1 adjusts the degree of opening of the second expansion valve 26 not according to the discharge temperature of the compressor 21 but according to the target value (target temperature difference) that does not depend on the type or operation status of the compressor 21. Thus, the injection amount can be controlled without the need for acquiring a great amount of data according to the type or operation status of the compressor 21.

If the degree of subcooling on the outlet side of the utilization-side heat exchanger 11 is too high, the enthalpy difference of the condenser increases, but the heat exchanger performance decreases and the level of high pressure increases. Thus, there is the degree of subcooling at which the operation efficiency is maximized. The air-conditioner 1 of the present embodiment sets the degree of subcooling at which the operation efficiency is maximized as the target degree of subcooling, determines the target temperature difference according to the target degree of subcooling, and adjusts the degree of opening of the second expansion valve 26 according to the target temperature difference. As a result, the operation efficiency of the air-conditioner 1 can be improved. When outdoor air is at a low temperature, the suction pressure of the compressor 21 decreases and the suction density thereof decreases, so that the amount of refrigerant held in the heat-source-side heat exchanger 23 relatively decreases and the degree of subcooling of the utilization-side heat exchanger 11 increases. In this case, the air-conditioner 1 of the present embodiment can increase the injection amount and improve the heating capacity by decreasing the target temperature difference.

Note that the present invention is not limited to the specific embodiment, and various modifications and changes can be made within the scope of the gist of the present invention described in the claims, such as application of a modification of a certain embodiment to another embodiment or modification.

As a first modification, the air-conditioner 1 may include a plurality of indoor units. In this case, each indoor unit is provided with a utilization-side heat exchanger. A control unit obtains the average of the degrees of subcooling of the plurality of utilization-side heat exchangers, and determines a target temperature difference according to this degree of subcooling.

As a second modification, a target temperature difference is a value determined according to the degree of subcooling, and is not necessarily a value at which the operation efficiency is maximized. The target temperature difference may only be required to be a value that decreases as the degree of subcooling increases.

A third modification will be described. In the embodiment, the opening degree adjustment unit 281 adjusts the degree of opening of the first expansion valve 25 on the basis of both of the discharged refrigerant temperature and suction superheat degree of the compressor 21. Note that the opening degree adjustment unit 281 may adjust the degree of opening of the first expansion valve on the basis of only the discharged refrigerant temperature. For example, in a case where the discharge temperature exceeds a predetermined target temperature, the degree of opening of the first expansion valve 25 may be increased. In this case, the discharge temperature can be decreased as well.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An air-conditioner comprising:

a main refrigerant circuit including a compressor, a heat-source-side heat exchanger, a first expansion valve, and a utilization-side heat exchanger;

a bypass path that allows part of refrigerant flowing from the utilization-side heat exchanger to the heat-source-side heat exchanger to join refrigerant compressed to an intermediate pressure by the compressor;

a second expansion valve that decompresses refrigerant flowing in the bypass path;

an internal heat exchanger that provides heat of refrigerant flowing from the utilization-side heat exchanger to the heat-source-side heat exchanger in the main refrigerant circuit to refrigerant decompressed in the bypass path;

an opening degree adjuster that adjusts, in heating operation, a degree of opening of the second expansion valve on the basis of a refrigerant temperature difference between an outlet and an inlet of the internal heat exchanger in the bypass path and a target temperature difference; and a setter that sets the target temperature difference on the basis of a degree of subcooling of the utilization-side heat exchanger.

2. The air-conditioner according to claim 1, wherein the target temperature difference when the degree of subcooling is a first value is greater than the target temperature difference when the degree of subcooling is a second value greater than the first value.

3. The air-conditioner according to claim 1, wherein the setter sets the target temperature difference on the basis of the degree of subcooling of the utilization-side heat exchanger and a preset target degree of subcooling.

4. The air-conditioner according to claim 1, further comprising:

a temperature sensor that senses a refrigerant temperature on a discharge side of the compressor, wherein the opening degree adjuster adjusts a degree of opening of the first expansion valve on the basis of the refrigerant temperature sensed by the temperature sensor and a target temperature.

5. The air-conditioner according to claim 4, wherein the opening degree adjuster further adjusts the degree of opening of the first expansion valve on the basis of a suction superheat degree of the compressor.

* * * * *